United States Patent [19]

Hanley

[11] 4,381,121

[45] Apr. 26, 1983

[54] HUMAN REPRODUCTION INDEXING DEVICE

[76] Inventor: John P. Hanley, 625 Ivy Ct., Kenilworth, Ill. 60043

[21] Appl. No.: 203,698

[22] Filed: Nov. 3, 1980

[51] Int. Cl.[3] ..... B42D 15/02

[52] U.S. Cl. ..... 283/1 A; 235/85 FC

[58] Field of Search ..... 283/1 A, 48 R; 235/85 R, 85 FC, 88 RC, 89; 40/107, 107 B

[56] References Cited

U.S. PATENT DOCUMENTS

| | | | |
|---|---|---|---|
| 1,595,585 | 8/1926 | Swan | 283/1 A X |
| 2,046,239 | 6/1936 | Bardrof | 235/85 FC X |
| 2,047,942 | 7/1936 | Culligan | 235/85 FC X |
| 3,146,943 | 9/1964 | Tsuji et al. | 235/85 FC |
| 3,625,418 | 12/1971 | Colon | 235/89 R X |

*Primary Examiner*—Gil Weidenfeld

*Assistant Examiner*—Fred A. Silverberg

*Attorney, Agent, or Firm*—Emrich, Lee, Brown & Hill

[57] ABSTRACT

A human reproduction indexing device for indicating the calendar dates for days of a menstrual cycle on which the probability of conception is the greatest includes a generally rectangular member having indicia representing the calendar dates for the days of given months positioned in three separate columns on the member and indicator-index columns aligned and positioned adjacent each of the separate columns on the member. When the calendar date corresponding to the day of the onset of the menses is known, the indicator-index columns indicate the calendar dates for an eight day interval starting ten days after the indexed date to provide the time interval during which ovulation should occur and thus the days on which the probability of conception are maximized.

3 Claims, 2 Drawing Figures

FIG. 1
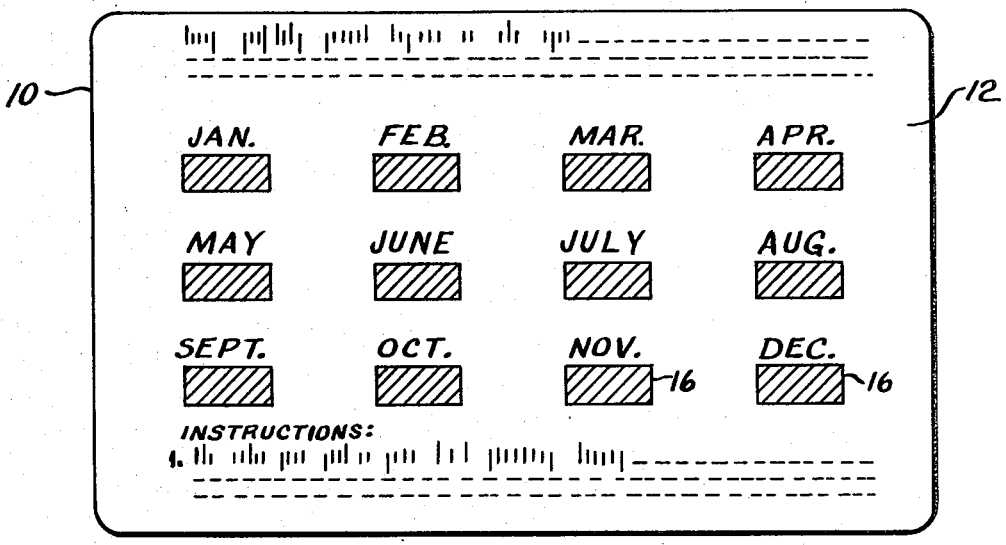
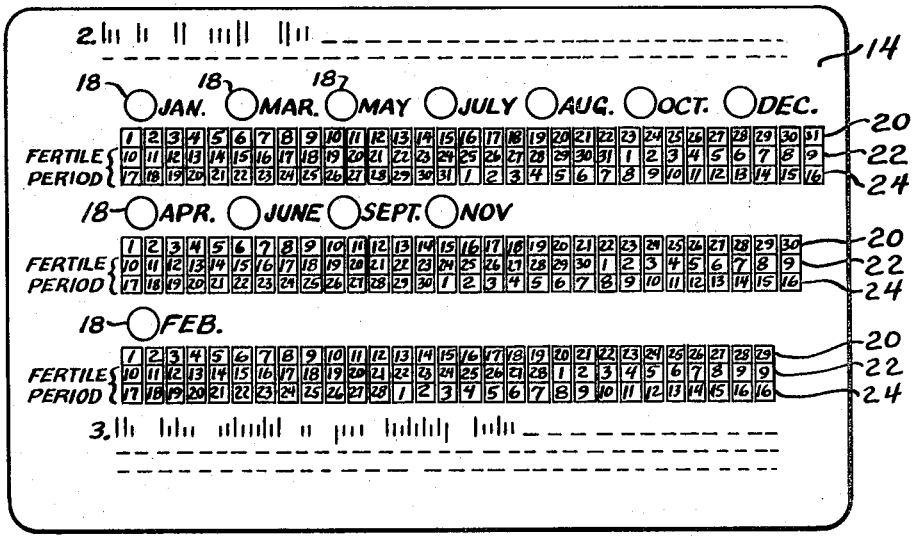
FIG. 2

HUMAN REPRODUCTION INDEXING DEVICE

BACKGROUND OF THE INVENTION

The present invention relates to a human reproduction indexing device for indicating the calendar dates for days of a menstrual cycle on which the probability of conception is maximized.

As is known in the art, timing is a very important consideration for those couples who want to have a baby as well as those who wish to practice some method of birth control. In particular, they must know the days of a menstrual cycle on which the probability of conception is the greatest. While it is generally known that there are a limited number of days during each month on which a woman can become pregnant, i.e. one to two days following ovulation, couples are often imprecise in guessing the fertile time because of minunderstandings as to the time of occurrance of ovulation, and how to predict when ovulation should occur.

There are a number of indirect methods for determining the time of ovulation. The method most frequently employed is the Basal body temperature (BBT) method which is based upon detection of the rise of a woman's body temperature that occurs around, or soon after the time of ovulation. However, the need to take and record daily temperatures is an inconvenience, and if it is not done the method loses its effectiveness. That is, the success of this method is dependent upon obtaining temperature readings regularly and upon proper interpretation of the recorded temperature information. Another method used by many females is the rhythm method. Although the rhythm method is one of the less effective methods of birth control, many females use this method because it conforms with their values. However, in many cases there are misunderstandings as to how the rhythm method is synchronized with the menstrual cycle, and this leads to misconceptions such as the ones that the highest risk of conception occurs just before and after menstruation.

In recent years, scientific approaches have been used to develop a way for predicting the woman's fertile period and the risk of conception. For example, an article by John C. Barrett and John C. Marshall entitled "The Risk of Conception on Different Days of the Menstrual Cycle" which appeared in *Population Studies*, Volume XXIII, No. 3, November, 1969, reports the results of a statistical analysis of data using a computer to correlate time of ovulation, frequency of coitus and the number of conception cycles. A mathematical function was developed which yielded the probability of conception on different days of the menstrual cycle. The study indicated that the risk of conception is small in the early part of the menstrual cycle. It increases noticeably about five days before ovulation and is maximum on the second day before ovulation. The risk of conception falls sharply by the second day following ovulation. The results of this study make it possible to predict high risk of conception times relative to ovulation. However, application requires use of the BBT method for the detection of the onset of ovulation.

A human reproduction indexing device for use in indicating when the probability of conception is the greatest have been known in the art, being shown, for example, in my earlier filed, co-pending application for United States Letters Patent, Ser. No. 947,568, filed Oct. 2, 1978, now issued as U.S. Pat. No. 4,232,215. The indexing device of my last mentioned application for Letters Patent, embody a base member having calendar indicia representing the calendar dates of at least one month disposed in a circular track on one surface and an index member having indexing portion and an indicator portion assembled together and rotatable with respect to the circular calendar dates to highlight when the probability of conception is the greatest. While such indexing devices have been successful, it is an important object of the present invention to provide an improvement over the fertility indicators heretofore known in the art.

SUMMARY OF THE INVENTION

The present invention provides a human reproduction indexing device for indicating the calendar dates for days of a woman's menstrual cycle on which the probability of conception is maximized. The indexing device includes a rectangular-shaped member having indicia representing the calendar dates for the days of the months with the indicia positioned in three separate columns for representing months having 31, 30 and 28 days, respectively. Aligned and positioned adjacent each of the separate columns on the member are indicator-index columns representing the fertile period.

The indexing device includes also on one side of the member a recording space positioned to correspond to each month of the year. This permits the user to record the day the menstrual cycle begins on the appropriate month and then turn the member over and determine the particular calendar date under the appropriate month. The indicator-index columns adjacent thereto identifying and representing the fertile period.

The indicator-indexing columns indicate the calendar dates for an eight day interval, starting ten days after the indexed date. The midpoint of the eight day interval, which is between the thirteenth and fourteenth days after the start of the menses, closely corresponds to the time ovulation should occur for a woman having a typical twenty-eight day menstrual cycle. The appropriate four days on each side of the midpoint provides a guard against irregularity should ovulation occur earlier or later than expected and the life expectancy of the ova and the sperm. The eight day interval on indicator-index columns are based upon a range of menstrual cycles from 26 to 33 days.

The indexing device is easy to use and provides an indication which is easily interpreted by the user. That is, once the date of menstrual cycle has been selected, the device clearly indicates the calendar dates for the days of a given menstrual cycle on which there is the highest probability of conception and conversely the grestest risk of pregnancy.

DESCRIPTION OF THE DRAWINGS

FIG. 1 is a perspective view of one side of the human reproduction indexing device in accordance with the present invention; and FIG. 2 is a perspective view showing the opposite side of the device shown in FIG. 1;

DESCRIPTION OF THE INVENTION

Referring to the drawings, the rectangular-shaped human reproduction indexing device or member 10 is comprised of a first side surface 12 and a second side surface 14 and it is within the scope of the present invention that the device 10 may be composed of plastic, paper or other suitable material. Positioned on the first side surface 12 are a plurality of recording spaces or means 16 corresponding to each month of the year to provide a permenent record, if desired, for the user of the date the user's menstrual cycle begins.

The indexing device 10 includes on a surface 14 calendar dates for the days of the several months 18 with the indicia 20 positioned in three separate columns for representing months having 31, 30 and 28 days, respectively. Aligned and positioned adjacent each of the separate columns on the member are indicator-index columns 22 and 24, respectively, representing the fertile period.

To understand the operation of the device 10 the user records the day the menstrual cycle begins on the appropriate recording space 16 on the side surface 12 and then turns the member over and determines the particular calendar date 20 under the appropriate month 18. The indicator-index columns 22 and 24 adjacent thereto identifying and representing the fertile period.

For example, if the users menstrual cycle commences November 15, that date is recorded in the recording space 16 on side 12. The device 10 is turned over and the month 18 in the middle row of calendar dates 20 is located. The indicator-index columns 22 and 24 located under November 15 indicates that the fertility period begins on November 24 and continues through December 1, a total of 8 days.

The indicator-indexing columns 22 and 24 indicate the calendar dates for an eight day interval, starting ten days after the indexed date. The midpoint of the eight day interval, which is between the thirteenth and fourteenth days after the start of the menses, closely corresponds to the time ovulation should occur for a woman having a typical twenty-eight day menstrual cycle. The appropriate four days on each side of the midpoint provides a guard against irregularity should ovulation occur earlier or later than expected and the life expectancy of the ova and the sperm. The eight day interval on indicator-index columns 22 and 24 are based upon a range of menstrual cycles from 26 to 33 days.

The indexing device 10 is easy to use and provides an indication which is easily interpreted by the user. That is, once the date of menstrual cycle has been selected, the device clearly indicates the calendar dates for the days of a given menstrual cycle on which there is the highest probability of conception and conversely and greatest risk of pregnancy.

I claim:

1. An indexing device for maximizing the probability of conception comprises a member having indicia representing the calendar dates for the days of the months positioned in three separate calendar columns on the member and indicator-index columns aligned with and positioned adjacent each of said calendar columns, said indicator-index columns indicating the calendar dates for an eight day cycle starting ten days after the predetermined index date to provide the time interval during which the probability of conception is maximized.

2. An indexing device in accordance with claim 1 further including a plurality of recording space means positioned on said indexing device for recording the predetermined index date.

3. An indexing device in accordance with claim 1 wherein said device is composed of plastic.

* * * * *